US006915913B2

(12) United States Patent
Cardinell

(10) Patent No.: US 6,915,913 B2
(45) Date of Patent: Jul. 12, 2005

(54) ATTACHMENT DEVICE FOR SHELVING AND ORGANIZER SYSTEMS

(75) Inventor: Jennifer L. Cardinell, Citra, FL (US)

(73) Assignee: Clairson, Inc., Newark, DE (US)

( * ) Notice: Subject to any disclaimer, the term of this patent is extended or adjusted under 35 U.S.C. 154(b) by 30 days.

(21) Appl. No.: 10/107,511

(22) Filed: Mar. 27, 2002

(65) Prior Publication Data

US 2003/0183592 A1 Oct. 2, 2003

(51) Int. Cl.[7] ..... A47F 5/08

(52) U.S. Cl. ..... 211/87.01; 211/119.003; 211/113

(58) Field of Search ..... 211/86.01, 87.01, 211/88.01, 73, 90.03, 113, 117, 175, 118, 119, 85.29, 85.24, 85.26, 115; 220/475, 751; 206/806; 40/660, 665, 617; 24/116 A, 598.1; 223/91, 93; 248/222.12, 214, 215, 301, 304, 317, 322, 339, 340, 229.14, 229.17, 226.11, 227.4

(56) References Cited

U.S. PATENT DOCUMENTS 1,340,870 A * 5/1920 Balboni ..... 217/56
2,411,856 A * 12/1946 Harding ..... 452/192
3,028,974 A * 4/1962 Loeb ..... 211/113
3,043,546 A * 7/1962 Reich ..... 248/215
3,240,384 A * 3/1966 Lermer ..... 220/780
3,347,505 A * 10/1967 Menser ..... 248/68.1
3,416,673 A * 12/1968 Ballard ..... 211/115
3,612,459 A * 10/1971 Walls ..... 248/215
3,669,276 A 6/1972 Woods ..... 211/34
3,782,747 A * 1/1974 Hamilton, Jr. ..... 40/128
4,101,103 A * 7/1978 Mooney et al. ..... 248/58
4,112,550 A * 9/1978 DeWitt et al. ..... 248/227.4
4,240,480 A 12/1980 Strobel ..... 150/3
4,314,646 A * 2/1982 Purnell ..... 211/113
4,441,583 A * 4/1984 Vaught ..... 182/150
4,761,904 A * 8/1988 Fast et al. ..... 40/308
4,762,237 A * 8/1988 Newton ..... 211/115
4,856,744 A * 8/1989 Frankel ..... 248/215
4,874,100 A * 10/1989 Smagula ..... 211/60.1
4,881,684 A * 11/1989 Chinman ..... 190/115
4,967,913 A * 11/1990 Bayer ..... 211/38
4,998,700 A * 3/1991 McKaig ..... 248/214
5,027,960 A * 7/1991 Rainville ..... 211/118
5,040,711 A 8/1991 Niederhauser et al. ... 224/42.46
5,071,003 A * 12/1991 Freelander ..... 206/282
5,074,419 A * 12/1991 Smith ..... 211/17
5,074,516 A * 12/1991 Lewis et al. ..... 248/691
5,094,060 A * 3/1992 Caird ..... 53/390
5,191,984 A * 3/1993 Kon et al. ..... 211/115
5,328,068 A * 7/1994 Shannon ..... 224/558
5,370,246 A * 12/1994 Traynor ..... 211/86.01
5,402,910 A * 4/1995 Pilney ..... 220/751
5,464,183 A * 11/1995 McConnell et al. ..... 248/311.2
5,507,460 A * 4/1996 Schneider ..... 248/225.21
5,531,416 A * 7/1996 Remmers ..... 248/222.51
5,800,061 A * 9/1998 Volles ..... 383/15
5,964,434 A * 10/1999 Lynch, Jr. ..... 248/60
6,145,659 A * 11/2000 Faircloth et al. ..... 206/292
6,158,593 A * 12/2000 Olsen ..... 211/14
6,302,281 B1 * 10/2001 Wang ..... 211/118
6,415,442 B1 * 7/2002 Smith ..... 2/69.5
6,457,635 B1 * 10/2002 Scicluna ..... 229/87.17
2002/0047079 A1 * 4/2002 Gerson ..... 248/339

* cited by examiner

*Primary Examiner*—Jennifer E. Novosad
(74) *Attorney, Agent, or Firm*—Harness, Dickey & Pierce, P.L.C.

(57) ABSTRACT

An attachment device and method of providing the same includes opposing flaps or tabs for securing around different portions of shelving, particularly ventilated shelving. The flaps or tabs are generally flexible and sets of the flaps or tabs are generally provided in perpendicular relation to each other. Each flap or tab includes a securing member for securing to each other around a portion of shelving. The attachment device is removably fastenable to shelving and associated components.

16 Claims, 4 Drawing Sheets

ATTACHMENT DEVICE FOR SHELVING AND ORGANIZER SYSTEMS

FIELD OF THE INVENTION

The present invention relates generally to storage systems, and more particularly to an attachment device for use with shelving and organizer systems.

BACKGROUND OF THE INVENTION

Efficient and organized use of building space is very desirable, particularly with respect to storage or utility space in businesses, residential homes and apartments. From appliances having space saving designs (e.g., washer and dryer stacked on top of one another) to closet organizers (e.g., wire shelving closet kits), manufacturers continue to develop new designs to maximize the use of space, while maintaining ease in access and user convenience.

With respect to closet organization and the design of closet storage units, because of the many different sizes and shapes of closets, (e.g., from walk-in closets to ones having sliding or pivoting doors), most closet storage designs require a determination of the specific dimensions of the closet in order to provide the best closet options (i.e., to maximize available space). Further, closet storage design and installation typically also factors in the needs or requirements of a user, and is typically not capable of easy modification after installation. The finished closet space must be visualized before installation. This is very difficult and often problems arise because the completed closet unit is not the same as the proposed pre-installation design and/or the user determines that changes are needed (e.g., need for more shoe storage space instead of space for hanging clothes).

It is common today to use ventilated shelving (e.g., wire, plastic, laminate or wood shelving) and associated components to construct storage units within closets. Typical ventilated shelving not only varies in size (e.g., different lengths and widths) and configuration (e.g., different wire mesh spacing), but also may include many after-installation options and hardware components ("add-ons") such as, for example, attachments and connectable members, to facilitate storage and maximize the use of space. Thus, these add-ons are provided in an attempt to increase the flexibility for modification of the closet system after initial installation. These add-ons may include shoe storage systems (e.g., expandable hanging or stackable shelves or compartments), hang rod attachments for supporting hanging rods, and stackable drawers, to name a few.

The problem with the installed shelving units is that modification is difficult after installation. For example, oftentimes when adding drawers or shelves after the initial installation, substantial cutting and other modifications (e.g., using adapters, brackets, etc.) are required to ensure proper attachment. Not only is this time consuming, but it is also frequently costly (e.g., if an entire shelf has to be removed and replaced).

In order to reduce the possibility of having to physically cut the shelves or make other permanent modifications, known devices, including add-ons, are used that attach to the existing shelving. With respect to mesh or ventilated shelving, extra shelves or racks (e.g., shoe racks) may have compressible connection members that are attached between the wires of the shelving to thereby secure them in place. Other devices may be provided to hang from the ventilated shelving or a hang rod may be attached thereto. However, known devices still lack flexibility and are limited to installation to specific portions of the shelving unit. It may be desirable to move an attached storage unit (e.g., an add-on) from the shelving to a hanging-rod and then back again. This may be needed when alternating between summer and winter clothes, which requires moving of items within the shelving unit.

Thus, known shelving devices for use after installation (e.g., add-ons), fail to provide needed design flexibility and frequently require permanent modifications for installation. Thus, not only is modification after installation difficult, but home fix solutions that are aesthetically unappealing may result (e.g., using duct tape to hang items).

SUMMARY OF THE INVENTION

The present invention provides an attachment device and method of providing the same for attaching a storage unit or other similar add-on device to shelving. Generally, the present invention provides at least two sets of opposing connection members for attaching to different portions or components of typical shelving. The present invention provides an attachment device for use with, for example, a hanging storage unit, and allows attachment to different support structures (e.g., a hang-rod or the wire members of ventilated shelving) using fastenable opposing flaps or tabs.

Specifically, an opposing flapped attachment device, having at least two sets or pairs of opposing flaps or tabs is provided. The opposing flaps or tabs are preferably flexible with fastenable members on each of the flaps or tabs for attaching to an opposing flap or tab, and to secure the attachment device to a portion of the shelving (i.e., opposing flaps or tabs surround a portion of the shelving). The opposing sets of flaps or tabs are preferably configured in perpendicular relation to each other, such that a storage unit provided therewith may be attached to portions of the shelving oriented in different directions. For example, the first set of flaps may be provided for securing a storage unit (e.g., an expandable shoe storage system) to the wire shelving and the second set of flaps may be used to secure a storage unit to a hang rod extending perpendicular to the wires of the shelving. Using an attachment device of the present invention, a storage unit may be attached (e.g., hung) to different portions of a shelving system, while allowing access to the contents of the storage unit in each position (i.e., the orientation of the storage unit opening is maintained in a position outward from the shelving for access by a user).

Thus, an attachment device that is easily installed and readily moveable within the shelving system is provided by the present invention. The ease of attachment and various options for connection results in a flexible and convenient design that reduces the cost of after-installation modifications. Costs are further reduced as a result of only requiring a single connector (i.e., reduce manufacturing costs), which also reduces inventory requirements.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. Thus, although the application of the attachment device of the present invention as disclosed herein is generally discussed in relation to particular storage units (e.g., a shoe storage system), it is not so limited and any type of storage unit, or other device, may be provided in connection therewith according to the principles of the present invention.

Figure 1:
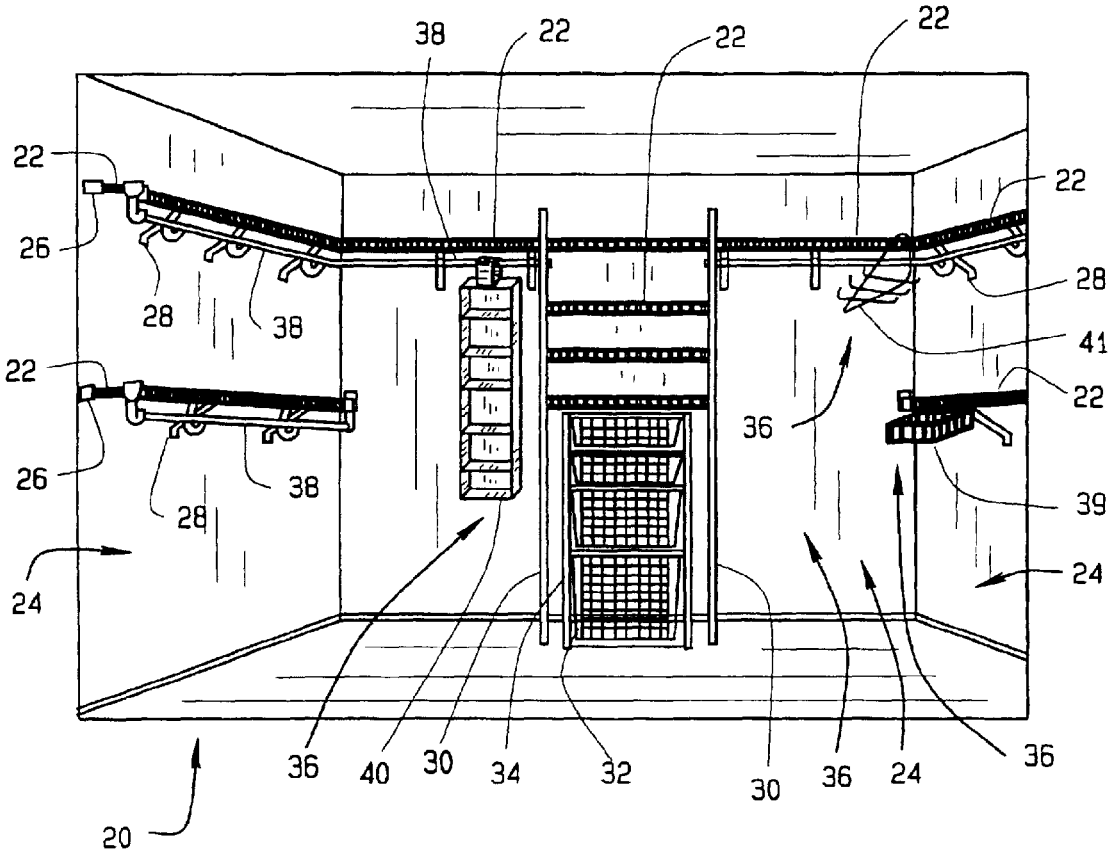
FIG. 1 is a perspective view of a storage system within a closet.
Figure 2A:
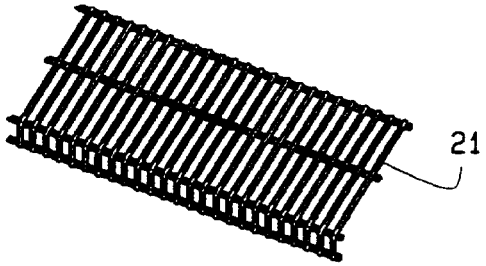
FIGS. 2(*a*)–2(*e*) are top perspective views of ventilated wire shelving.
Figure 2B:
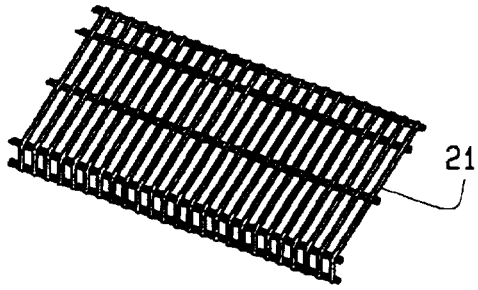
Figure 2C:
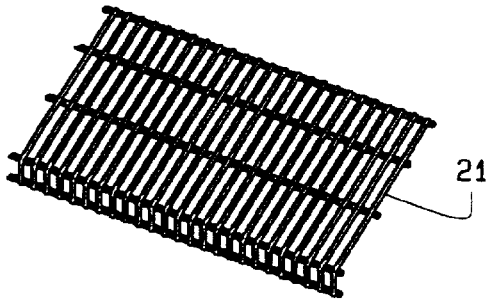
Figure 2D:
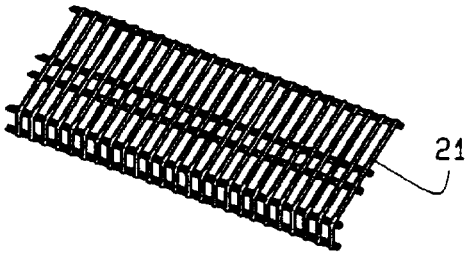
Figure 2E:
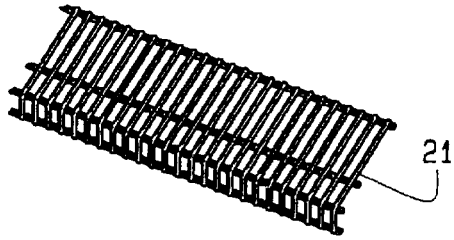

Referring to FIG. 1, a closet 20 (e.g., a walk-in closet) having a shelving system installed therein is typically provided with a plurality of shelves 22 (e.g., ventilated shelves). The shelves 22 may be of different sizes (e.g., 4, 6, 8 or 10 foot and/or cut to a custom size) and are typically mounted to walls 24 of the closet 20 using end brackets 26 and support brackets 28. The depth of the shelves 22 and the spacing of the wires 21 may also be different as shown in FIGS. 2(*a*)–(*e*). Further, the wires 21 may be oriented longitudinally or transversely relative to the shelves 22.

Additional components may be needed for installation of a shelving system, such as, for example, shelf support poles 30. Separate free-standing add-ons 32 (e.g., free-standing drawers) may also be provided. These free-standing add-ons 32 are preferably provided with support members 34 (e.g., drawer frame). Attachable add-ons 36, such as storage devices, may also be connected to the shelving 22 to provide additional storage. These attachable add-ons 36 include, for example, hang-bars or rods 38, a sliding/hanging basket 39, a hanging shoe storage unit 40, or a tie/belt rack 41.

Referring again to FIG. 1, the attachable add-ons 36 are adapted for attachment in a specific orientation to the shelving 22 (e.g., around the wires 21 of the shelves 22 or around a hang-bar or rod 38). Further, as shown therein, the attachable add-ons 36 are adapted for installation only to certain portions of the shelving system. For example, the hanging shoe storage unit 40 is adapted to hang only from a hang-bar or rod 38 or other member oriented in the same direction relative to the shelves 22. The sliding/hanging basket 39 is adapted for installation only under the shelves 22 and attached to the wires 21 of the shelves 22 in a specific manner.

Figure 3:
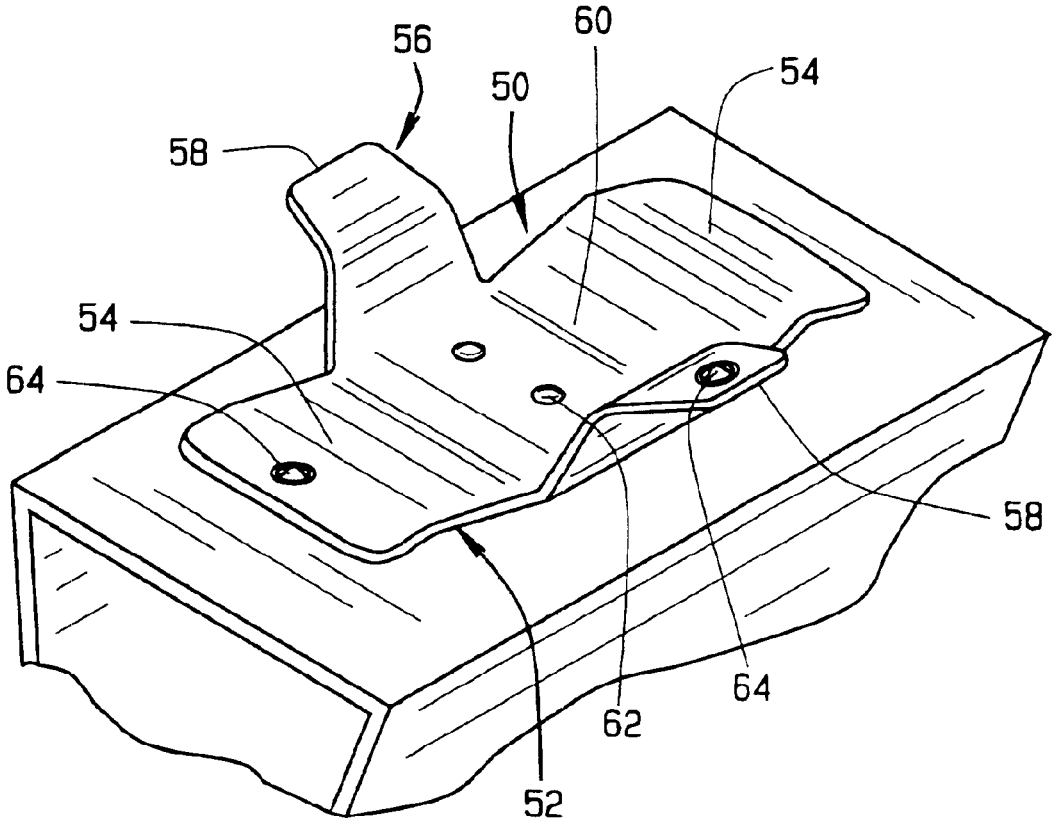
FIG. 3 is a top perspective view of an attachment device constructed according to the principles of the present invention.

With respect specifically to an attachment device 50 of the present invention as shown in FIG. 3, that may be used with, for example, a shelving system, the attachment device 50 preferably includes means for removable connection to a first portion of shelving, and means for removable connection to a second portion of shelving. In a preferred embodiment, the attachment device 50 includes a first connection member 52 having a first set of opposing flaps or tabs 54 and a second connection member 56 having a second set of opposing flaps or tabs 58. As shown therein, the axis of the first set of flaps or tabs 54 is preferably generally perpendicular to the axis of the second set of flaps or tabs 58.

The first connection member 52 and the second connection member 56 are preferably constructed as a single unit 60 having the generally flexible flaps or tabs 54 and 58 integrated therein. The unit 60 is preferably permanently attached to a storage unit, which may include, for example, a shoe storage unit 40. The attachment of the single unit 60 to a storage unit may be provided using any type of securing member, including, for example, a locking fastener, grommet or rivets 62.

Figure 4A:
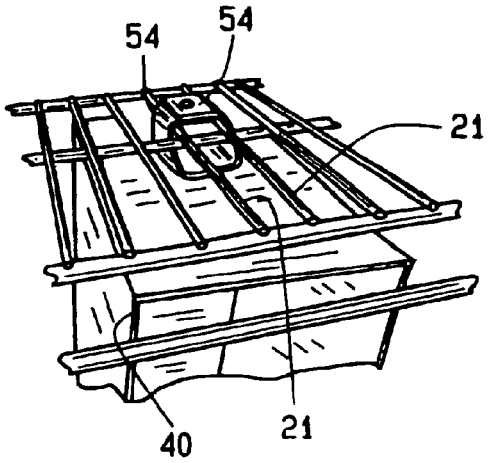
FIGS. 4(*a*) and 4(*b*) are perspective views of an attachment device of the present invention fastened to the wires of ventilated shelving.
Figure 4B:
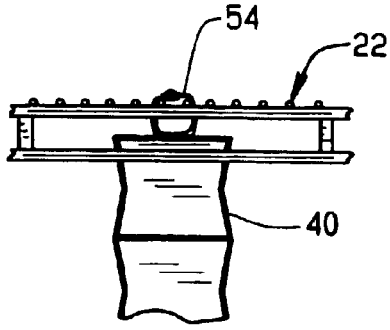
Figure 5A:
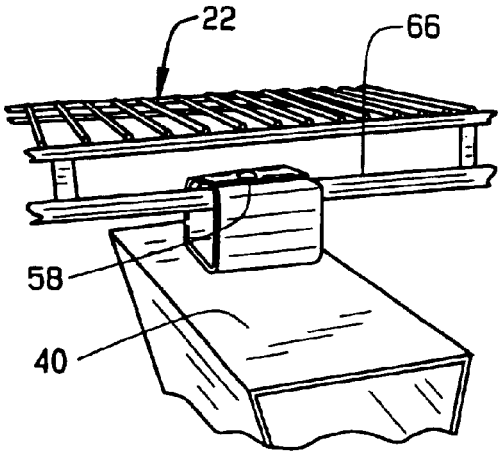
FIGS. 5(*a*) and 5(*b*) are perspective views of an attachment device of the present invention fastened to a hang wire of ventilated shelving.
Figure 5B:
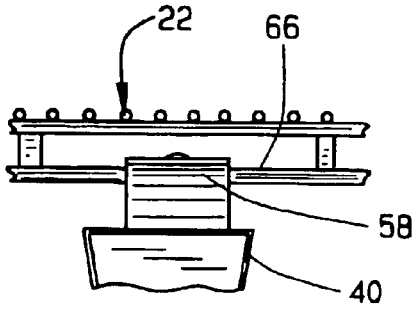

The flexible flaps or tabs 54 and 58 are configured for fastening around different portions of shelves 22, or attachments thereto, using complementary fastening members 64 (e.g. snaps). Specifically, and for example, as shown in FIGS. 4(*a*) and 4(*b*), the first set of flaps or tabs 54 are preferably adapted for fastening around a first portion of the shelves 22 (e.g., around the wires 21 of a shelf 22 using the complementary fastening members 64). It should be noted that depending upon the size of the wires 21 and the spacing between wires 21, the flexible flaps or tabs 54 may be fastened around one or more wires 21. The second set of flaps or tabs 58 are preferably adapted for fastening around a second portion of the shelves 22 (e.g., around a hang bar 38 or horizontal wire 66 perpendicular to the first portion) as shown in FIGS. 5(*a*) and 5(*b*). It should be noted that the flexible flaps or tabs 54, 58 may be constructed of any suitable material, including for example, canvas or other similar fabric.

In operation, the attachment device 50 of the present invention is adapted for removable fastening or attachment to various portions of shelving 22, as is needed or required depending upon the shelving configuration or set-up. Specifically, and referring again to FIGS. 4(*a*)–(*b*) and 5(*a*)–(*b*), the attachment device 50 as shown therein is adapted for removable fastening to shelving either axially or transversely in relation to the wires 21 of the shelves 22 (e.g., ventilated shelves), with the storage unit opening remaining accessible (i.e., facing outward away from the shelving). However, it should be noted that the attachment device 50 may be implemented with different flap or tab 54, 58 alignment configurations relative to the shelving 22 depending upon the specific requirements and type of shelving (e.g., the attachment device 50 may be secured to a storage unit such that the connection members 52 and 56 are adapted for connection to opposing corners of the shelving 22 with the storage unit opening remaining accessible).

It should also be noted that the attachment device may be provided with any type of storage device or attachable add-on 36 and is not limited to a hanging shoe storage unit 40. Further, the flaps or tabs 54 and 58 may be provided in different sizes and shapes, or as any suitable connection member, which may include, for example, a semi-rigid plastic connector. The connection members 52 and 56 may be provided as separate members that are attached separately, either permanently or removably, to a storage unit. More than two connection members may also be provided. The fastening members 64 may be snaps or any other suitable fastening means, such as, for example, a Velcro® fastener. Further, an additional fastening member may be provided on each flap or tab to secure it to the storage device when not in use. Also, more that one attachment device 50 may be provided in connection with a single storage unit. Further, additional flaps or tabs may be provided (e.g., 3 or 4 sets of flaps or tabs).

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A storage device adapted for connection to shelving, the storage device comprising:

a storage member having an opening and adapted for storing at least one item of wearing apparel therein; and a connection member adapted for connecting the storage member to either selected one of a first portion of shelving extending in a first generally horizontal direction and a second portion of shelving extending in a second generally horizontal direction different than the first generally horizontal direction with the storage member opening accessible and oriented in substantially the same direction when the storage member is connected by the connection member to the first portion of shelving and when the storage member is connected by the connection member to the second portion of shelving, the connection member comprising at least a first attachment component for removable connection to the first portion of shelving and a second attachment component for removable connection to the second portion of shelving.

2. The storage device according to claim 1 wherein the attachment components each comprise a flexible portion having opposing ends.

3. The storage device according to claim 2 wherein each opposing end comprises a fastening member for fastening the opposing ends to each other and for removable attachment to the shelving.

4. The storage device according to claim 2 wherein the first attachment component and the second attachment component are configured in generally perpendicular orientation to each other.

5. The storage device according to claim 2 wherein the first attachment component comprises opposite, projecting flaps along a first axis and the second attachment component comprises opposite, projecting flaps along a second axis generally perpendicular to the first axis.

6. The storage device according to claim 5 wherein the opposite, projecting flaps of one of the first and second attachment components are configured for secured attachment around a portion of the shelving.

7. The storage device according to claim 6 wherein the first attachment component is connected to the storage member in a generally parallel orientation to the storage member opening and the second attachment component is connected to the storage member in a generally perpendicular orientation to the storage member opening.

8. The storage device according to claim 6 wherein the first attachment component is configured for removable attachment to the shelving generally axially in relation to the storage member.

9. The storage device according to claim 8 wherein the second attachment component is configured for removable attachment to the shelving generally transversely in relation to the storage member.

10. The storage device according to claim 6 wherein the first attachment component is configured for removable attachment around a plurality of shelving wire members.

11. The storage device according to claim 10 wherein the second attachment component is configured for removable attachment around a shelving hang-rod.

12. A device for use with shelving, the device comprising:

a first set of generally flexible opposing flaps configured for connecting to a portion of the shelving and having complementary fastening members on each flap for securing one flap to the other around the shelving;

a second set of generally flexible opposing flaps disposed in a generally perpendicular axis to the first set of generally flexible opposing flaps, the second set of generally flexible opposing flaps configured for connecting to a portion of the shelving and having complementary fastening members on each flap for securing one flap to the other around the shelving; and a storage member coupled to the first and second sets of generally flexible opposing flaps, the storage member having an opening and adapted for storing at least one item of wearing apparel therein, the storage member opening being accessible and oriented in substantially the same direction when the first set of generally flexible opposing flaps are secured to one another around the shelving and when the second set of generally flexible opposing flaps are secured to one another around the shelving.

13. The device according to claim 12 wherein the first set of generally flexible opposing flaps and the second set of generally flexible opposing flaps are configured as a single member.

14. A method for attaching a storage device to shelving, the storage device including a first set of opposing flaps and a second set of opposing flaps configured in a generally perpendicular relation to each other, the method comprising:

selecting one of the first and second sets of opposing flaps for attaching the storage device to the shelving; and securing the opposing flaps of the selected set to one another around a portion of the shelving to thereby attach the storage device to the shelving.

15. The method of claim 14 further comprising:

unsecuring the opposing flaps of the selected set from one another and from around said portion of the shelving; and securing the opposing flaps of the other one of the first and second sets to one another around a portion of the shelving to thereby attach the storage device to the shelving.

16. The method of claim 14 wherein the storage device includes a side opening and wherein the side opening is accessible and oriented in substantially the same direction when the storage device is attached to the shelving by the first set of opposing flaps and when the storage device is attached to the shelving by the second set of opposing flaps.

* * * * *